United States Patent [19]

Fuller

[11] Patent Number: 4,823,892

[45] Date of Patent: Apr. 25, 1989

[54] ROTARY DRILL BITS

[75] Inventor: John Fuller, Penzance, England

[73] Assignee: NL Petroleum Products Limited, England

[21] Appl. No.: 118,604

[22] Filed: Nov. 9, 1987

Related U.S. Application Data

[62] Division of Ser. No. 754,506, Jul. 12, 1985, Pat. No. 4,718,505.

[51] Int. Cl.[4] ..... E21B 10/46

[52] U.S. Cl. ..... 175/329; 175/410

[58] Field of Search ..... 175/329, 409, 410, 411

[56] References Cited

U.S. PATENT DOCUMENTS

| | | | |
|---|---|---|---|
| 3,938,599 | 2/1976 | Horn | 175/410 |
| 4,512,426 | 4/1985 | Bidegaray | 175/329 |
| 4,554,986 | 11/1985 | Jones | 175/329 |
| 4,570,726 | 2/1986 | Hall | 175/329 |
| 4,681,174 | 7/1987 | Aubakirov et al. | 175/410 |

*Primary Examiner*—Jerome W. Massie, IV
*Assistant Examiner*—Terry Lee Melius
*Attorney, Agent, or Firm*—Browning, Bushman, Zamecki & Anderson

[57] ABSTRACT

A rotary drill bit for use in drilling or coring deep holes in subsurface formations comprises a bit body having a shank for connection to a drill string and a plurality of cutting elements mounted at the surface of the bit body. Each cutting element is bonded to a stud which is received in a socket in the bit body. Spaced rearwardly of each cutting element is a separate abrasion element comprising a stud which is received in a socket in the bit body and is impregnated with particles of natural or synthetic diamond. The abrasion element provides a back-up in the event of failure or excessive wear of the cutting element and its spacing from the cutting element prevents the damaging transfer of heat from the abrasion element to the cutting element. The cooling may be enhanced by providing a channel for drilling fluid between the cutting element and abrasion element.

1 Claim, 4 Drawing Sheets

FIG.3
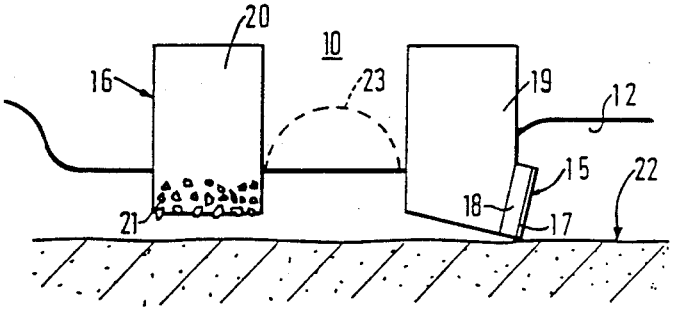
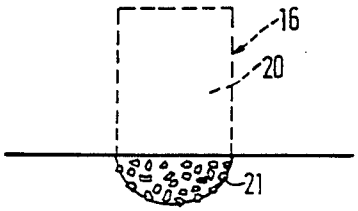
FIG.4
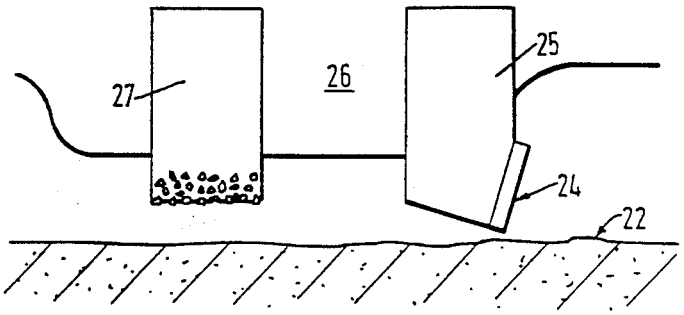
FIG.5

ROTARY DRILL BITS

This is a division of application Ser. No. 754,506, filed July 12, 1985, now U.S. Pat. No. 4,718,505.

BACKGROUND OF THE INVENTION

The invention relates to rotary drill bits for use in drilling or coring deep holes in subsurface formations, and of the kind comprising a bit body having a shank for connection to a drill string, a plurality of cutting elements mounted at the surface of the bit body, and a passage in the bit body for supplying drilling fluid to the surface of the bit body for cooling and/or cleaning the cutting elements, at least some of the cutting elements each comprising a preform cutting element having a superhard front cutting face. The invention is particularly, but not exclusively, applicable to drill bits of this kind in which the cutting elements comprise preforms having a thin facing layer of polycrystalline diamond bonded to a backing layer of tungsten carbide. Various methods may be used for mounting such cutting elements on the bit body but such methods, and the general construction of bits of the kind to which the invention relates, are well known and will not therefore be described in detail.

When drilling deep holes in subsurface formations, it often occurs that the drill passes through a comparatively soft formation and strikes a significantly harder formation. Also there may be hard occlusions within a generally soft formation. When a bit using preform cutters meets such a hard formation the cutting elements may be subjected to very rapid wear.

In order to overcome this problem it has been proposed to provide, immediately adjacent the rearward side of at least certain of the cutting elements, a body of material impregnated with natural diamond. For example, in the case where the bit body is a matrix material formed by a powder metallurgy process, it is known to mount each cutting element on a hard support which has been cast or bonded into the material of the bit body and in one such arrangement the hard support has been impregnated with diamond.

With such an arrangement, during normal operation of the drill bit the major portion of the cutting or abrading action of the bit is performed by the cutting elements in the normal manner. However, should a cutting element wear rapidly or fracture, so as to be rendered ineffective, for example by striking hard formation, the diamond-impregnated support on which the element is mounted takes over the abrading action of the cutting element thus permitting continued use of the drill bit. Provided the cutting element has not fractured or failed completely, it may resume some cutting or abrading action when the drill bit passes once more into softer formation.

A serious disadvantage of such an arrangement is that abrasion of the diamond-impregnated support against the formation generates a great deal of heat and the resultant high temperature to which the adjacent cutting element is subjected tends to cause rapid deterioration and failure of the cutting element and/or its attachment to the support. The present invention therefore sets out to provide arrangements in which this disadvantage is reduced or overcome.

SUMMARY OF THE INVENTION

According to the invention, a rotary drill bit for use in drilling or coring deep holes in subsurface formations comprises a bit body having a shank for connections to a drill string, a plurality of cutting elements mounted at the surface of the bit body, and a passage in the bit body for supplying drilling fluid to the surface of the bit body for cooling and/or cleaning of the cutting elements, at least some of the cutting elements each comprising a preform cutting element having a superhard front cutting face, there being spaced from at least certain of said cutting elements, with respect to the normal direction of rotation of the bit, an abrasion element comprising particles of superhard material, such as natural or synthetic diamond, embedded in a carrier element mounted on the bit body. Preferably each abrasion element is spaced rearwardly of its associated cutting element, with respect to the normal direction of rotation.

The abrasion elements may be so positioned with respect to the leading surface of the drill bit that they do not come into cutting or abrading contact with the formation until a certain level of wear of the cutting elements is reached.

Preform cutting elements are susceptible to greater wear and risk of failure as their temperature rises, and by spacing the abrasion elements from the cutting elements overheating of the cutting elements and/or their attachments to the bit body, due to engagement of the abrasion elements with the formation, may be kept to a minimum. A waterway for drilling fluid may be provided in the surface of the drill bit between the cutting elements and abrasion elements to minimise transfer of heat to the cutting elements.

The particles of superhard material may be embedded throughout the carrier element and/or may be embedded in the surface of the carrier element so as to project therefrom. The carrier element may be formed from cemented tungsten carbide.

The carrier element may comprise a stud received in a socket in the bit body. For example the stud may be substantially cylindrical and have an end face which is exposed at the surface of the bit body when the stud is received in its socket.

The abrasion elements may be arranged in any configuration with respect to the cutting elements, but preferably each abrasion element which is spaced rearwardly of an associated cutting element is located at substantially the same radial distance from the axis of rotation of the bit as its associated cutting element. This ensures that the abrasion element provides a precise back-up for the cutting element.

Each cutting element may be mounted directly on the bit body, for example by being bonded thereto. Alternatively, each cutting element may be mounted on a carrier, such as a stud, which is received in a socket in the bit body.

There may be provided on the surface of the bit body, in generally known manner, a plurality of blades extending outwardly with respect to the axis of rotation of the drill bit, and in this case each cutting element and its associated abrasion element may be mounted on the same blade, but spaced apart with respect to the direction of rotation of the bit.

As previously mentioned, each cutting element may be a preform coprising a thin hard facing layer bonded to a less hard backing layer. Alternatively each cutting element may comprise a preformed unitary layer of thermally stable polycrystalline diamond material.

The invention also includes within its scope a rotary drill bit for use in drilling or coring deep holes in subsurface formation, comprising a bit body having a shank for connection to a drill string, a plurality of preform cutting elements mounted at the surface of the bit body, and a passage in the bit body for supplying drilling fluid to the surface of the bit for cooling and/or cleaning the cutting elements, the bit body being formed from steel, and each cutting element being mounted on a stud received in a socket in the steel bit body, the stud including, rearwardly of the cutting element with respect to the normal direction of rotation of the bit, particles of superhard material embedded in the stud, at least the portion of the stud which includes the particles of superhard material projecting clear of the bit body.

In such an arrangement, since both the cutting element and the portion of the stud containing the abrasion particles project clear of the bit body, the projecting portion of the stud will be subjected to cooling by the drilling fluid, thus reducing the heat transfer to the cutting element.

The invention also includes within its scope a rotary drill bit for use in drilling or coring deep holes in subsurface formations, comprising a bit body having a shank for connection to a drill string, a plurality of preform cutting elements mounted at the surface of the bit body, and a passage in the bit body for supplying drilling fluid to the surface of the bit body for cooling and/or cleaning the cutting elements, the bit body being formed from steel, and each preform cutting element comprising a unitary layer of thermally stable, polycrystalline diamond material bonded to a carrier received in a socket in the steel body of the bit.

BRIEF DESCRIPTION OF THE DRAWINGS

FIG. 3 is a diagrammatic section through a cutting element and associated abrasion element.

FIG. 4 is a front view of an abrasion element, and

FIGS. 5 to 7 are similar views to FIG. 3 of alternative arrangements.

DETAILED DESCRIPTION OF THE PREFERRED EMBODIMENTS

Figure 1:
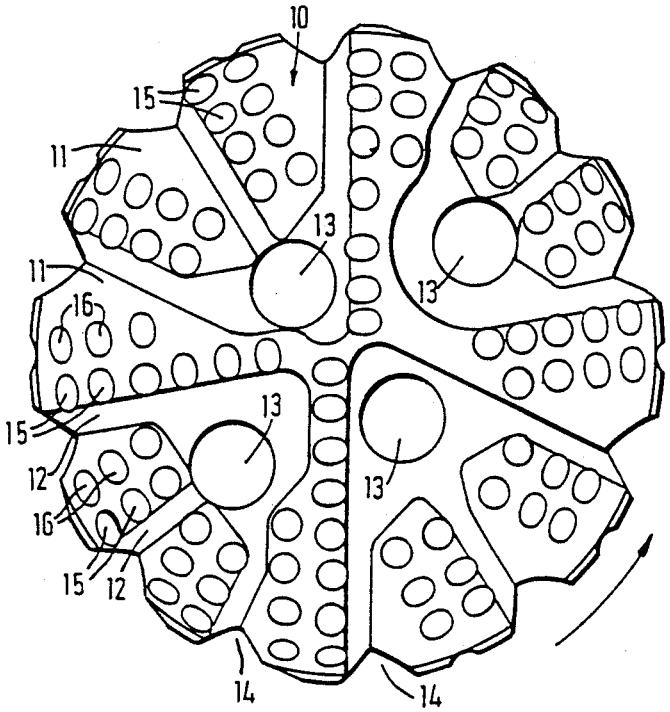
FIGS. 1 and 2 are front end views of rotary drill bits according to the invention.

The rotary bit body of FIG. 1 has a leading end face 10 formed with a plurality of blades 11 upstanding from the surface of the bit body so as to define between the blades channels 12 for drilling fluid. The channels 12 lead outwardly from nozzles 13 to which drilling fluid passes through a passage (not shown) within the bit body. Drilling fluid flowing outwardly along the channels 12 passes to junk slots 14 in the gauge portion of the bit.

Mounted on each blade 11 is a row of cutting elements 15. The cutting elements project into the adjacent channel 12 so as to be cooled and cleaned by drilling fluid flowing outwardly along the channel from the nozzles 13 to the junk slots 14. Spaced rearwardly of the three or four outermost cutting elements on each blade are abrasion elements 16. In the arrangement shown each abrasion element lies at substantially the same radial distance from the axis of rotation of the bit as its associated cutting element, although other configurations are possible.

Figure 2:
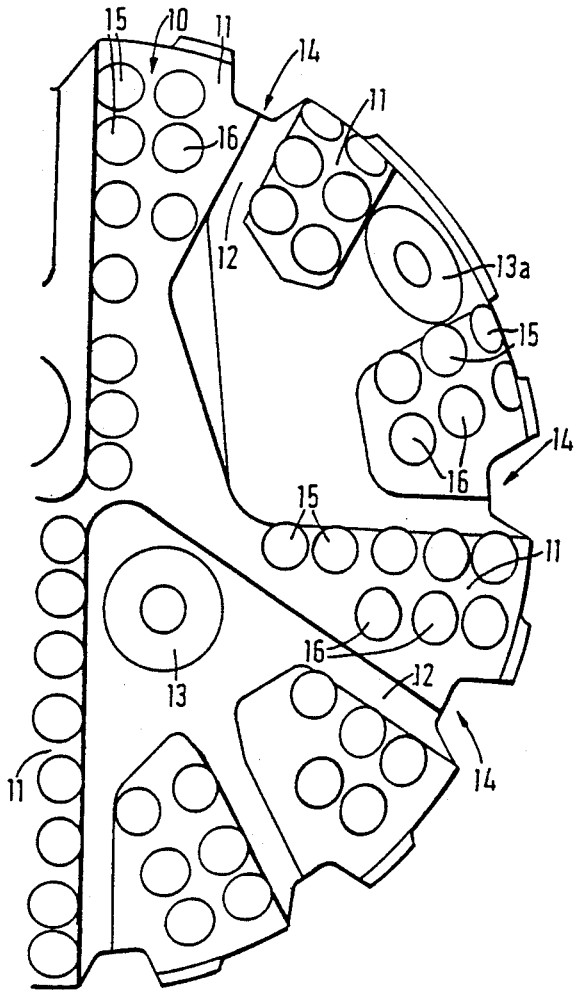

FIG. 2 shows an alternative and preferred arrangement in which some of the nozzles are located adjacent the gauge region of the drill bit, as indicated at 13*a* in FIG. 2. The flow from such a peripheral nozzle passes tangentially across peripheral portions of the leading face of the bit to the junk slots 14, thus ensuring a rapid and turbulent flow of drilling fluid over the intervening abrasion and cutting elements so as to cool and clean them with efficiency.

In either of the arrangements described, the cutting elements 15 and abrasion elements 16 may be of many different forms, but FIG. 3 shows, by way of example, one particular configuration.

Referring to FIG. 3, it will be seen that each cutting element 15 is a circular preform comprising a front thin hard facing layer 17 of polycrystalline diamond bonded to a thicker backing layer 18 of less hard material, such as tungsten carbide. The cutting element 15 is bonded, in known manner, to an inclined surface on a generally cylindrical stud 19 which is received in a socket in the bit body 10. The stud 19 may be formed from cemented tungsten carbide and the bit body 10 may be formed from steel or from matrix material.

Each abrasion element 16 also comprises a generally cylindrical stud 20 which is received in a socket in the bit body 10 spaced rearwardly of the stud 19. The stud 20 may be formed from cemented tungsten carbide impregnated with particles 21 of natural or synthetic diamond or other superhard material. The superhard material may be impregnated throughout the body of the stud 20 or may be embedded in only the surface portion thereof.

Referring to FIG. 4, it will be seen that each abrasion element 16 may have a leading face which is generally part-circular in shape.

The abrasion element 16 may project from the surface of the bit body 10 to a similar extent to the cutting element, but preferably, as shown, the cutting element projects outwardly slightly further than its associated abrasion element, for example by a distance in the range of from 1 to 10 mm. Thus, initially before any significant wear of the cutting element has occurred, only the cutting element 15 engages the formation 22, and the abrasion element 16 will only engage and abrade the formation 22 when the cutting element has worn beyond a certain level, or has failed through fracture.

In the arrangement shown, the stud 20 of the abrasion element is substantially at right angles to the surface of the formation 22, but operation in softer formations may be enhanced by inclining the axis of the stud 20 forwardly or by inclining the outer surface of the abrasion element away from the formation in the direction of rotation.

In order to improve the cooling of the cutting elements and abrasion elements, further channels for drilling fluid may be provided between the two rows of elements as indicated at 23 in FIG. 3.

Figure 6:
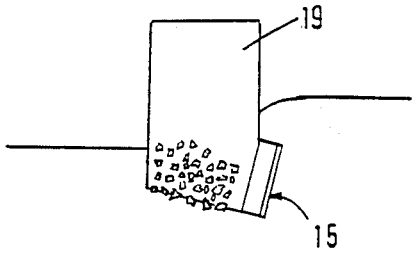
Figure 7:
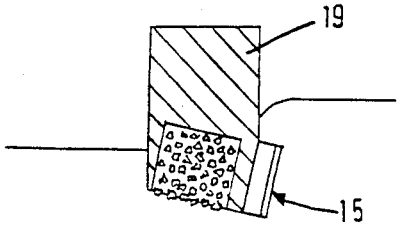

Although the abrasion elements 16 are preferably spaced from the cutting elements 15 to minimise heat transfer from the abrasion element to the cutting element, the invention also includes within its scope arrangements in which the bit body is formed from steel and each abrasion element is incorporated in the support stud for a cutting element. Such arrangements are shown in FIGS. 6 and 7. In the arrangement of FIG. 6 particles of diamond or other superhard material are impregnated into the stud 19 itself rearwardly adjacent the cutting element 15. In the alternative arrangement shown in FIG. 7, a separately formed abrasion element impregnated with superhard particles is included in the stud.

Any known form of cutting element 15 may be employed and the invention includes in its scope arrangements where the cutting element is mounted directly on the bit body, or on another form of support in the bit body, rather than on a cylindrical stud such as 19.

As previously mentioned, arrangements are known in which cutting elements are mounted directly on diamond-impregnated supports cast or bonded into the material of the bit body. In such arrangements it has been the practice to braze the cutting elements on to the supports after the supports have been mounted in the bit body. Soft brazing is carried out at comparatively low temperature, to prevent thermal damage to the cutting elements, and the bond thus formed is therefore particularly susceptible to weakening as a result of substantial heat transfer from the diamond-impregnated support. In such cases, therefore, there is a tendency for the bond to fail, leading to detachment of the cutting element, before the cutting element itself is seriously affected.

According to another aspect of the invention, therefore, it is proposed to bond the cutting element to a diamond-impregnated support before the support is mounted in the bit body. This enables the cutting elements to be bonded to the support by the process known as LS bonding or by diffusion bonding, which produces a bond which is much less susceptible to deterioration or failure due to heat transfer.

FIG. 5 shows an arrangement where the cutting element 24 is in the form of a unitary layer of thermally stable polycrystalline diamond material bonded without a backing layer to the surface of a stud 25, for example of cemented tungsten carbide, which is received in a socket in a bit body 26 which in this case is formed from steel. In accordance with the present invention, an abrasion element 27 is spaced rearwardly of each cutting element 24, but it will also be appreciated that the form of cutting element shown in FIG. 5 may also be used in any conventional manner in a steel body bit without the additional abrasion elements in accordance with the present invention.

I claim:

1. A rotary drill bit for use in drilling or coring holes in subsurface formations, comprising a bit body having a shank for connection to a drill string, a plurality of preform cutting elements mounted at the surface of the bit body, and a passage in the bit body for supplying drilling fluid to the surface of the bit for cooling and/or cleaning the cutting elements, the bit body being formed from steel, and each cutting element being premounted on a separately preformed stud which is subsequently mounted in a preformed socket in the steel bit body, the stud including, rearwardly of the cutting element with respect to the normal direction of rotation of the bit, particles of superhard material embedded in the stud prior to the mounting of said stud in said preformed socket, at least a portion of the stud which includes the particles of superhard material projecting clear of the bit body.

* * * * *